US005472091A

United States Patent [19]

Hewitt et al.

[11] Patent Number: 5,472,091

[45] Date of Patent: Dec. 5, 1995

[54] COMBINED PHOTO AND NEGATIVE STORAGE CONTAINER

[75] Inventors: Richard E. Hewitt; John K. Clay, both of Santa Barbara, Calif.; William L. Bartlett, Santa Fe, N.M.

[73] Assignee: Endeavour IV, Inc., Santa Barbara, Calif.

[21] Appl. No.: 267,609

[22] Filed: Jun. 29, 1994

[51] Int. Cl.[6] ..... B65D 85/57

[52] U.S. Cl. ..... 206/455; 206/472

[58] Field of Search ..... 206/454, 455, 206/472, 474, 461

[56] References Cited

U.S. PATENT DOCUMENTS 5,016,752 5/1991 Hauger, Jr. ..... 206/455
5,161,907 11/1992 Byrne ..... 206/455 X
5,251,747 10/1993 Hansen et al. ..... 206/455 X
5,303,825 4/1994 Hansen et al. ..... 206/455 X
5,316,138 5/1994 Thompson ..... 206/472 X

*Primary Examiner*—Jacob K. Ackun
*Attorney, Agent, or Firm*—Marvin E. Jacobs

[57] ABSTRACT

A storage container holding photographs and/or negatives in segregated chambers in which a central polypropylene frame is wrapped with a resin coated non-acid paperboard membrane. The membrane is spaced away from the frame by a variety of projections so as to form the chambers. The central frame is rigid and dimensionally consistent to allow stacking of the containers even though the paperboard membrane is flexible and forms 3 exterior walls of the container.

21 Claims, 3 Drawing Sheets

COMBINED PHOTO AND NEGATIVE STORAGE CONTAINER

TECHNICAL FIELD

This invention pertains to a container for storing photographic prints and, more particularly, this invention relates to stackable containers having separate compartments for storing the prints and developed negative film strips.

BACKGROUND OF THE INVENTION

Photographic laboratories process roll film into strips of developed negative film and individual positive prints. The prints and film are returned to the customer in a package, usually a pair of paper envelopes. The inner envelope usually has a separate pocket for storage of the strips of developed film. The envelopes are used for a variety of print sizes such as 4×6 and 3×5 inches and strips of film such as 110 and 35 mm. The prints and strips of film can slide about. Once the adhesive seal of the envelopes are broken, the flap is usually torn. In any case, the open flap allows dirt and moisture into the envelope and onto the surface of the prints.

Many photographs are taken as a family history and as remembrances of childhood and of relatives no longer alive. They are valuable family mementos. Also photographic prints and film are stored by companies for commercial or forensic reasons. However, photographic prints tend to curl after they are dried at the end of processing. The soft, loosely filled envelopes also curl making it impractical to stack the envelopes. Most envelopes end up in a random pile in a box or a drawer. They tend to become disorganized over the years and are unsightly and unmanageable when a particular roll of film is sought. Furthermore, the low profile of the edges of the envelopes precludes edge labeling.

Sometimes, the pictures are returned in a cardboard box which can be a bit more rigid and protective, but is much more expensive. U.S. Pat. No. 4,413,734 to Newcombe discloses a cardboard box for storing film, not photos. Such simple boxes can not economically segregate the photos from the negatives and are not rigid nor square enough for stacking. Cardboard boxes can be insufficiently strong to provide permanent protection for the film, absorb moisture and soften during storage. Furthermore, most cardboards are made from kraft pulp. The residual sulfate salts and/or acidic lignins in the cardboard can react with and degrade the silver and silver salts in the negatives and photograph prints over long periods of time.

Plastic containers are not subject to degradation by moisture, can be stronger than cardboard and can be made of materials that are inert and do not degrade nor react with the silver or silver halide images in the negative films and positive prints.

The positive and negative storage container disclosed in U.S. Pat. No. 5,016,752 is on the market. The container has the overall shape and configuration of a book. The cover is connected to the base by a live hinge side wall. A storage compartment is formed on the inside of the cover and guides are provided to store prints in the base. The container includes many different parts requiring expensive molds. This container is much more expensive than paper envelopes and would not be considered for use in replacing the traditional envelopes in which developed prints are returned to the customer from the processor.

A more intricate photograph print storage system is disclosed in U.S. Pat. No. 4,473,154. A spring based slide arrangement shuttles the prints to a viewing window.

U.S. Pat. No. 4,095,694 to Jost discloses several different plastic container designs for photos and negatives. Separate compartments are provided for photos and negatives, each accessible through a pivoting lid. This design is very expensive because each container requires several different plastic parts which must be separately molded at considerable extra cost.

U.S. Pat. No. 3,710,977 to Enden et al. discloses a light-tight container for storing light sensitive sheets and exposed sheets that may be made from cardboard or plastic including an ejecting mechanism.

U.S. Pat. No. 4,545,486 to Bostic discloses a plastic tray for storing a stack of photos. An additional recess in the bottom of the tray is sized to accept negatives. The photographic prints and negatives are not segregated so that the negatives could be disturbed whenever the photos are accessed. A separate plastic cover snaps on to the top of the tray. Bostic states that several of the trays could be stacked, but for larger numbers of trays, he requires a special rack with slots for the trays. Again, the storage unit is formed of several separate plastic parts. This increases the cost and complexity of the storage unit.

SUMMARY OF THE INVENTION

A container for safe storage of photographic prints and/or strips of negative film is provided by the present invention. The storage container has a first compartment for storing the photographic prints and an optional, second compartment for receiving the strips of film. The prints can be accessed separately from the strips of film with no concern that the strips will slip out of their compartment. The containers of the invention when stacked on top of each other reliably engage mating male and female structures allowing stacking as high or higher than a typical bookcase shelf such as 12–16 inches. The container of the invention is readily made by a single molding operation and a die cutting step. The cost of manufacture is much less than the prior plastic containers. In fact, the cost is so low that the container of the invention could be supplied by the processor to package the prints and negative strips from a single roll of film.

The storage container of the invention is formed of an inner rigid, rectangular, plastic perimeter member and an outer flexible membrane. The inner member provides a structural central frame about which a 3 sided membrane is positioned. The central frame has a base, 3 fixed side walls and a front wall hinged to the base wall by means of a live hinge. The base wall and 3 side walls define a compartment for storing photographic prints. The base wall can be raised from the lower edge of the side walls and can contain a channel for receiving strips of negatives.

The front edge of the lower panel of the membrane contains an aperture which engages a clip mounted on the lower forward edge of the central frame. The bottom edges of the side walls of the frame can be provided with small ledges to guide and retain the lower panel of the membrane.

As the lower panel of the membrane is slid onto the guides and into engagement with the clip, it forms a cover for the channel that can be used to store the negative strips, thus providing a closed compartment for the strips of film. The intermediate panel of the membrane closes the access to the film strip compartment and the top panel of the membrane closes and covers the compartment for storing the prints. Means are provided on the side walls and the cover for latching the cover and retaining the top panel of the membrane in closed position. The presence of a stack of photos in the upper compartment can act as a reinforcement for the top panel of the membrane.

The bottom edges of the side wall of the central frame contains projections which engage the side walls and/or cover of the adjacent storage container providing reliable stacking of the units. The bottom wall of the frame can contain a pin that is received in the same aperture as the latch for the cover. Vertical stops can be provided on the inner side walls of the frame to engage the projections from the adjacent storage container. The vertical stops can also act as spacers for the print compartments. A further spacer can be mounted at the rear end of the base wall to space the prints from the rear wall. The position of the end spacer depends on the length of the photographic prints.

A basic mold can be used to manufacture containers having a compartment for larger prints such as 4×6 inches. The mold can be modified with inserts to form inboard guides for smaller prints such as 3½×5 inch prints.

This invention only requires molding one integral member as a central frame for a photograph and/or negative film container. The container of the invention does not contain 6 external molded plastic walls to form a rectangular enclosure for the photos and negatives, nor does it require separate molded parts to form such an enclosure. Rather, the container of the invention utilizes a low cost cardboard or paperboard membrane that wraps about the central plastic frame to form 3 of the enclosing walls. As previously discussed, cardboard and paperboard can contain acid materials that can react with the color dies or silver grains in positive prints or negatives. The invention uses specially treated, non-acid paperboard. To further extend longevity of the membrane, the top and bottom surface of the paperboard can be coated with a thin coating of resin. The coatings encapsulate the paperboard and prevent absorption of moisture. The coatings also isolate any acid chemicals within the paperboard preventing the chemicals from contacting the stored prints and negatives. The coatings can be transparent or opaque. A preferred coating for the front surface is a high gloss, resin such as an acrylic esterpolymer. A thermoplastic film can be thermally laminated onto the cardboard such as a polyester or polyethylene film to provide an attractive, shiny surface. The coating on the inside surface need not be high gloss resin. It can be a clear resin such as emulsion polymerized polyethylene. The resin coatings can contain an ultraviolet absorber to increase the useful life of the resin coatings and paperboard membrane.

The flexible membrane is positioned by projections from the central frame that align and space the membrane away from the central frame so as to create chambers between the frame and membrane that hold the photos and negatives. This arrangement has numerous advantages.

The membrane is easily and cheaply manufactured by die cutting and scoring. The membrane can be customized with information embossed or printed thereon. Hence, the container may be made to carry the name and advertising of the film processor at essentially no additional cost. If the container were all plastic, individual and expensive molds would have to be made for each of the thousands of retailers that utilize the container to store processed film.

The frame can be made from many plastics. Thermoplastic molding resins are preferred. Resins that evolve gasses that can degrade the film or print such as polystyrene or ABS should be avoided. Suitable resins are linear polyesters such as Mylar or polyalkylene resins such as polyethylene or polypropylene. The ideal resin for the frame, polypropylene, is not practically markable. However, paperboard is markable with simple, well known, low cost printing methods. The paperboard, by itself, is not rigid enough to be protective, durable, and stackable. But with the central plastic frame, all the desired mechanical characteristics are achieved. Thus, the unique combination of a rigid plastic frame with a flexible, coated paperboard membrane gives performance better than either material used separately.

Some projections from the central frame locate the stack of photos. Other projections from the central frame form guides to allow stacking of the frames upon each other to considerable heights. Still other projections form the hinged cover catch and lock the membrane into place about the frame. All of these projecting means may be molded as a part of the single central frame due to the fact the frame is centrally positioned and operates as a sort of backbone to the structure, rather than being a hollow walled enclosing box as in the prior art.

These advantages and many other features, attendant advantages and benefits will become apparent as the invention becomes better understood by reference to the following detailed description when considered in conjunction with the accompanying drawings.

DETAILED DESCRIPTION OF THE INVENTION

Figures 1, 2, 6:
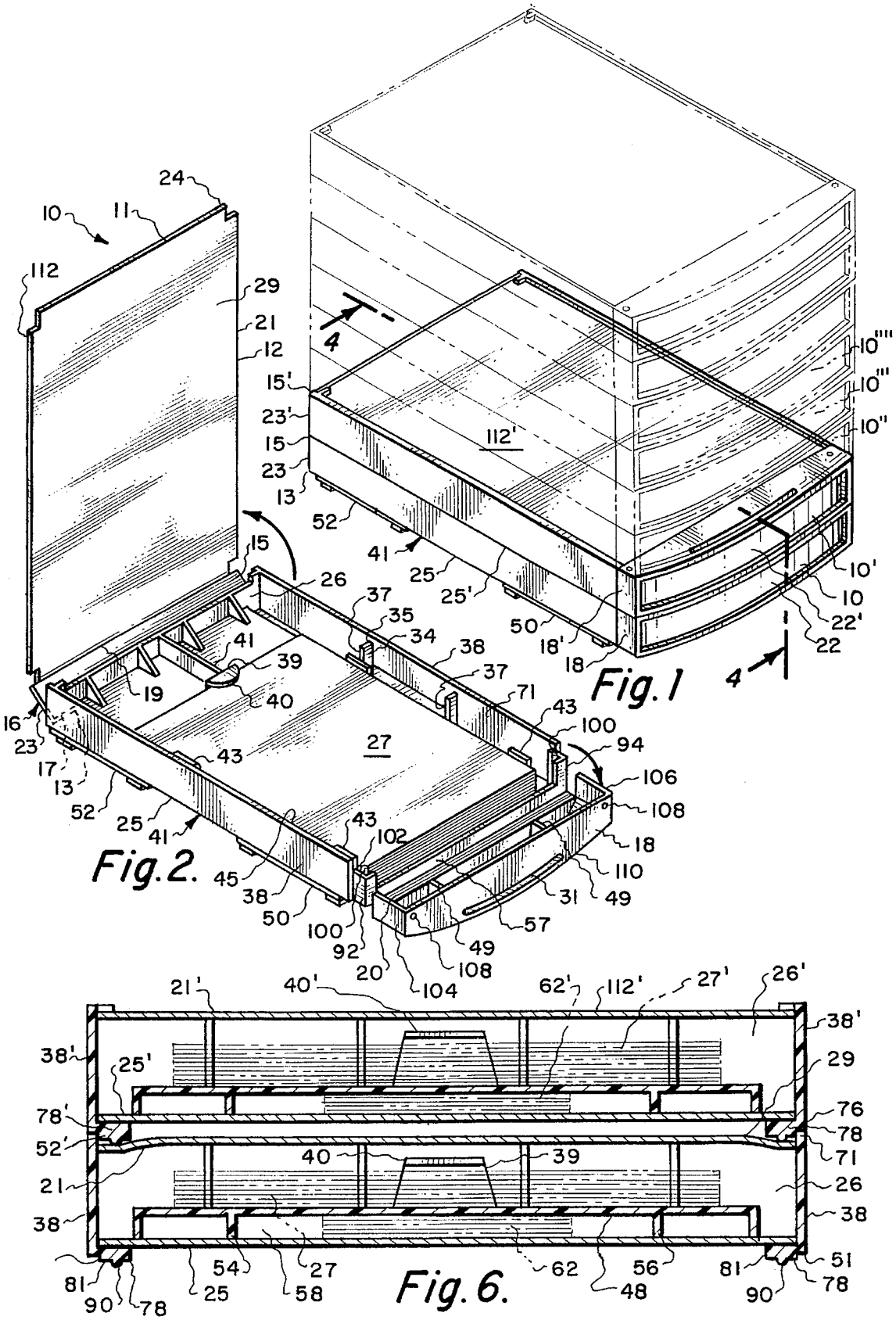
FIG. 1 is a perspective view of the container of this invention in the closed configuration shown stacked between adjacent like containers.
FIG. 2 is a perspective view of a container for storing 3½×5 inch photographic prints with the cover open to show photographic prints stored inside.
FIG. 6 is a view in section taken on line 6—6 of FIG. 4.
Figure 3:
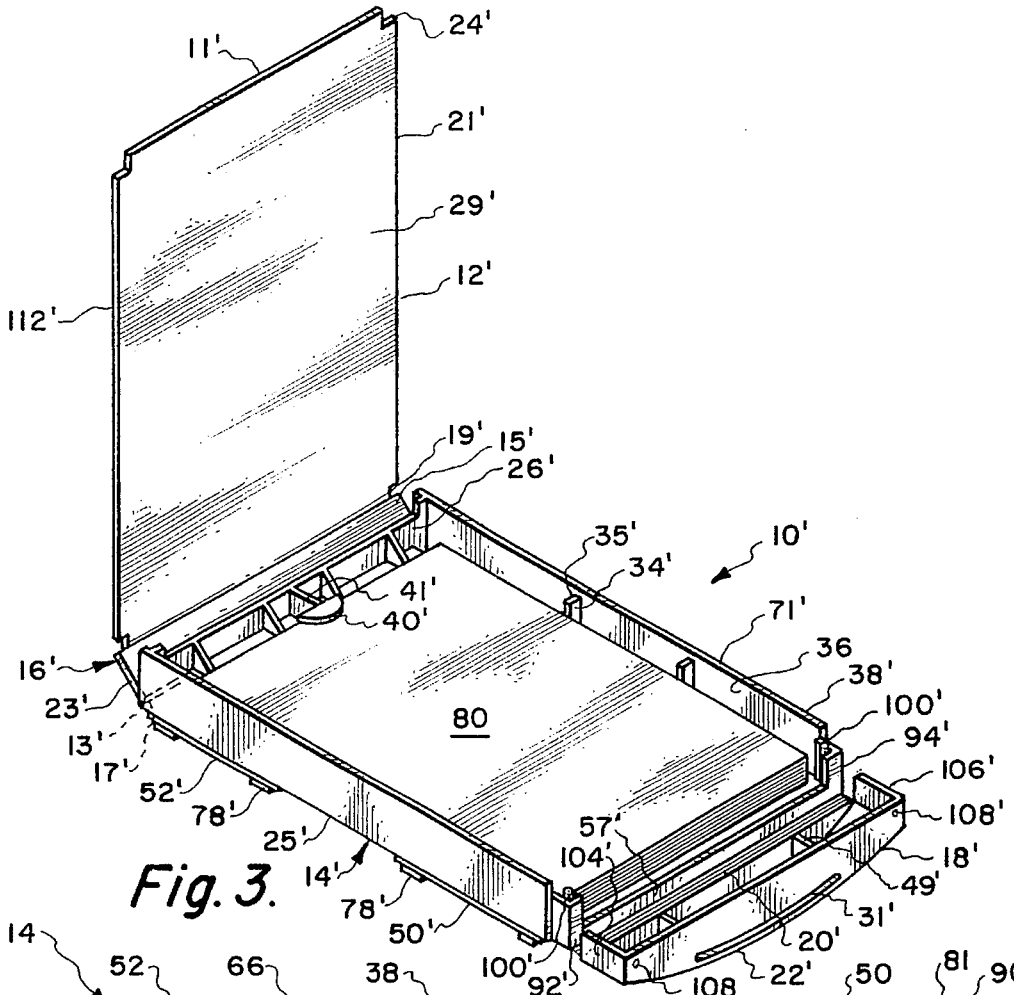
FIG. 3 is a perspective view of a container for storing 4×6 inch photographic prints with the cover shown open.

Referring now to FIGS. 1–6, and principally to FIGS. 2–3, two versions of photographic print and negative film strip containers 10 and 10' of this invention, are illustrated with the covers 12, 12' disposed in an open position. The storage containers 10, 10' of the invention include a central, hollow, generally rectangular frame 14, 14' and a three paneled, flexible membrane 16, 16' enclosing the frame 14, 14'. The central frame 14, 14' comprises a generally planar, rigid plastic structure that incorporates numerous projecting means extending out from central frame 14, 14' so as to accomplish a variety of functions. The membrane 16, 16' has live hinges 13, 13' and 15, 15' provided by score lines 17, 17' and 19, 19'. The flexible membrane 16, 16' is wrapped about the various projecting means. The membrane bends along the score lines 17, 17' and 19, 19'. The panels 21, 21', 23, 23' and 25, 25' form the top, end and bottom exterior walls of the container. The outer surface of the membrane 16, 16' can be coated with a layer 27, 27' of high gloss resin and the inner surface of the membrane 16, 16' can be coated with a layer 29, 29' of low gloss resin.

Figure 7:
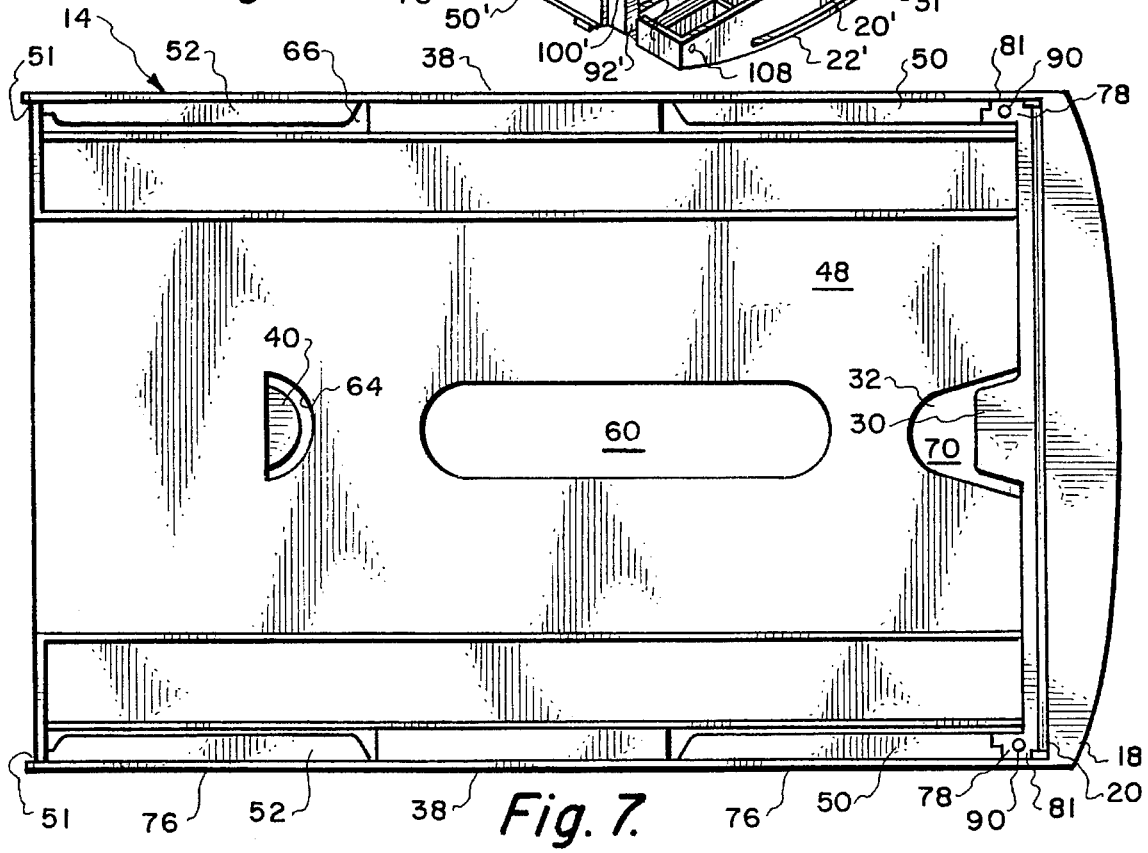
FIG. 7 is a bottom view in elevation of the frame of the container of the invention.
Figure 4:
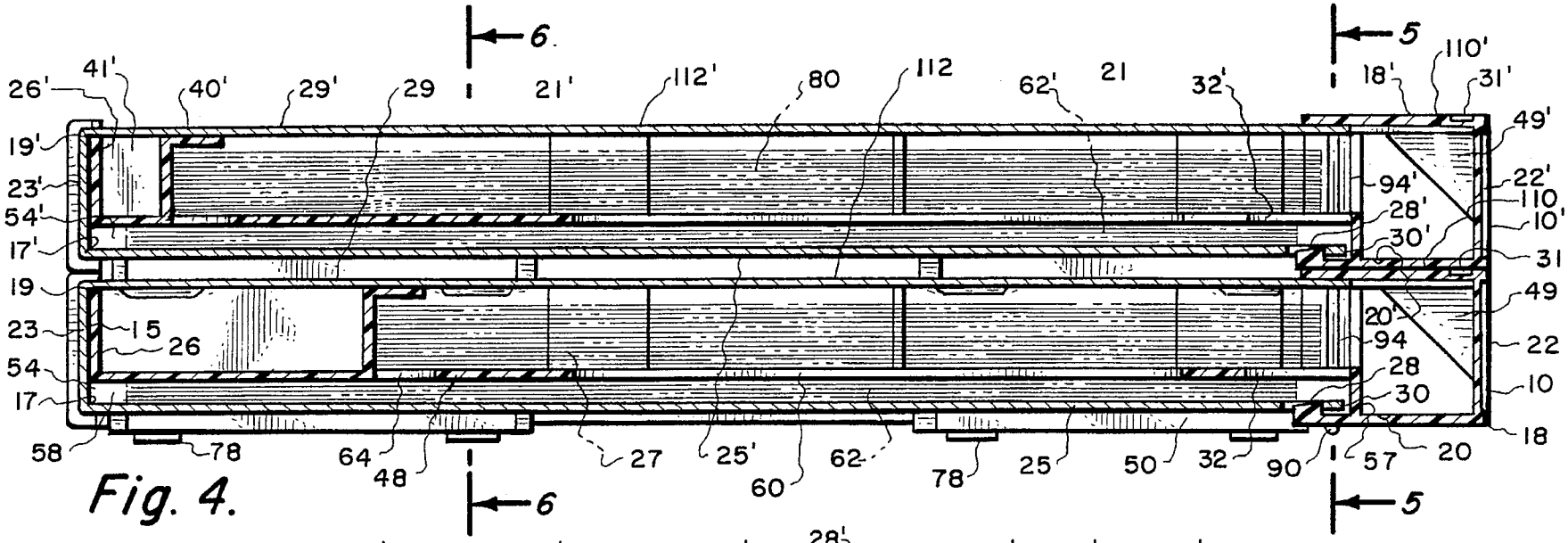
FIG. 4 is a view in section of the stack of container shown in FIG. 1 taken on line 4—4 of FIG. 1.
Figure 5:
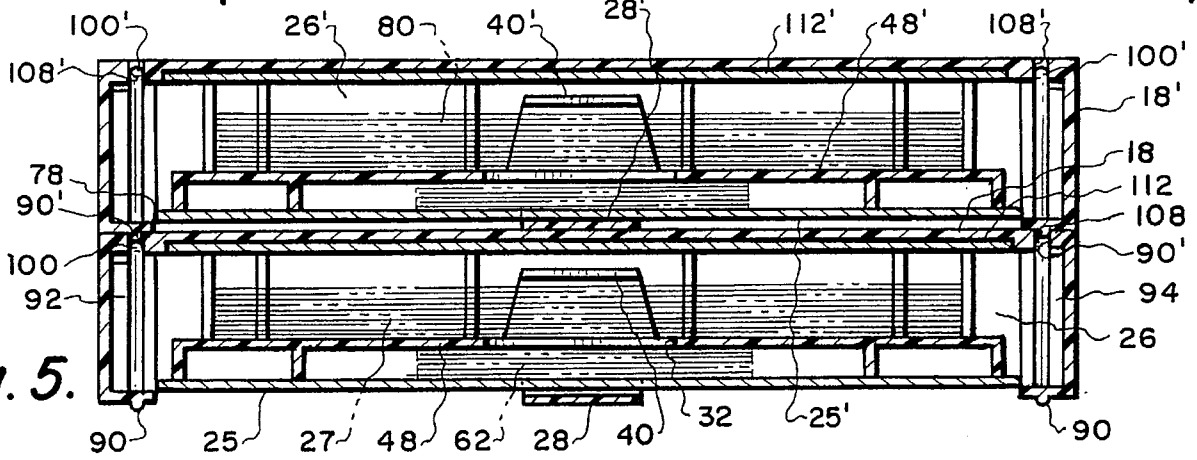
FIG. 5 is a view in section taken along line 5—5 of FIG. 4.

Frame 14, 14' is molded with an integral hinged cap 18, 18' that bends about a live hinge 20, 20'. Hinge 20, 20' comprises a scored line of plastic that is more flexible. Cap 18, 18' can have an exterior recess 22, 22' within which an adhesive label may be positioned to identify the contents of the container as shown in FIG. 1. Membrane 16, 16' has a narrower tab portion 24, 24' at the end of the cover part 11, 11' that is trapped under cap 18, 18' in the closed position. The hollow cap 18, 18' can contain vertical walls 49, 49' which reinforce the cap and prevent photoprints 27, 27' from sliding forward when the cap is closed. The cap can contain a recessed groove 31, 31' to facilitate opening the cap 18, 18'. At the end opposite from the cap 18, 18' central frame 14, 14' has an end wall 26, 26' around which membrane 16, 16' wraps. The other end of membrane 16, 16' has an aperture 28, 28' that slides up and over a ramped catch 30, 30' so as to hold the end of membrane 16, 16' at the bottom of the cap end of frame 14, 14'. Catch 30, 30' is easily molded as a projection from the central frame 14, 14' by providing a hole 32, in the intermediate panel 48 of the frame 14, 14' as shown in FIG. 7.

The frame includes an end wall 26 and side walls 38 and an intermediate panel 48. The panel 48 is positioned above the lower edge of the side walls 38. A series of raised horizontal runners 50, 52 are connected to the inner, bottom edge 51 of the side walls 38 and form grooves 54 with the panel 48 for slidingly receiving the bottom panel 25 of the membrane 16. The side walls 38 are reinforced by projections 34. The projections 34 end below the top edge of the side walls 38 forming horizontal ledges 35 for supporting the top panel 21 of the membrane in a recessed position. The inner, vertical edges 37 of the projections 34 can function as side guides for a cavity 36 for receiving large photoprints 80 such as 4×6 inch prints as shown in FIG. 3.

A rear retainer 39 with a horizontal lip 40 forms the back limit for the cavity 36. The cap 18 forms the front face of the cavity 36. The rear print retainer 39 can be connected to a support rib 41. The lip 40 is disposed in the same plane as the ledges 35 and forms another point of support for the top panel 21 or cover 12 or the membrane 16.

The same mold and container can also be adapted to store smaller prints 27 such as 3½×5 inch prints as shown in FIG. 2. In this version of the container 10, side guides 43 are provided inboard of the side walls 38. The rear retainer 39 is moved forward to the rear edge of the prints 4 to form a smaller cavity 45. The rib 41 is longer, extending from rear wall 26 of the frame to the retainer 39.

An optional compartment 58 for storing strips 52 of negative film can be provided since panel 48 is raised above the lower edges 51 of the side walls 38. Reinforcement ribs 54, 56 connected to the bottom face of the panel 48 can form the side walls of film compartment 58. The bottom panel 25 of the membrane forms another side of the compartment 58. A partial front wall 57 forms the front wall of the compartment and the intermediate panel 23 of the membrane 16 closes the compartment 58 when the membrane 16 is in closed condition. The ramped catch 30 is mounted on the inner face of the front wall 57.

As shown in FIG. 7, the panel 48 can be provided with a large oval slot 60 to aid in sliding the strips 62 of film out of the compartment 58. The elongated side apertures 66 are provided to aid in molding the horizontal runners 50, 52, the semicircular aperture 64 is to permit molding of the rear photoprint retainer 39. Circular side apertures, not shown, can be provided to mold the side guides and the front aperture 70 is provided for molding the clip assembly for the membrane.

The bottom and top surfaces of the frame contain several different interlocking structures which cooperate to permit stacking of the photoprint containers 10, 10', 10''', etc. as shown in FIG. 1. The bottom wall as previously described, contains horizontal guides or runners. These runners are disposed slightly inboard of the side wall 38.

The top edges 71 of the side walls 38 form a rigid strong surface upon which identical containers can be stacked. The side walls 38 are reinforced by the projections 34. The horizontal runners 50, 52 are placed slightly inboard of the outer face of the side walls 38 to expose the lower edges 76 of the walls 38. The runners 50, 52 may be provided with pads 78. Pins 90 may be provided at the forward end of the frame on the bottom face 81 of a set of walls 92, 94 slightly set in from the side walls 38. The walls 92, 94 also contains pins 100 extending upwardly from the top edge 102 of the side walls 92, 94. The walls 92, 94 are covered by the side walls 104, 106 of the cap 18 and the pins 100 are partially received in apertures 108 in the top wall 110 of the cap when the cap is closed.

When the containers are stacked, the pins 90 are received in the open portion of the apertures 108. The runners 50, 52 are received within the side walls 38 and rest on the membrane panel 21 which seats on the ledges 35 of the projections 34. The lower edges 76 of the side walls 38 rest on the upper edges 71 of the side walls 38 of the next adjacent container 10'.

All of these alignment and guide projections cooperate to insure that the containers may be stacked to considerable heights, one upon the other. Since only the rigid plastic parts engage each other, and the flexible markable membrane is recessed below the plane of engagement, accurate, stable, aligned stacking is guaranteed. Of course, other types of aligning and guiding projections could be designed that would work as well.

It is to be realized that only preferred embodiments of the invention have been described and that numerous substitutions, modifications and alterations are permissible without departing from the spirit and scope of the invention as defined in the following claims.

We claim:

1. A container for storing photograph prints and/or negatives comprising:

a central molded plastic frame;

a flexible membrane shaped and adapted to wrap about said frame;

projecting means on said frame adapted to space said membrane from said frame so as to create at least one chamber between said frame and said membrane, said at least one chamber being sized to accept photograph prints and/or negatives therewithin; and stacking projections extending out from said frame and beyond said membrane to allow stacking of one container upon another.

2. The container of claim 1 including photograph print locating projections extending from said frame so as to locate a stack of photograph prints in the photograph accepting chamber.

3. The container of claim 1 including stacking projections extending out from said frame and beyond said membrane to allow stacking of one container upon another and also including a cap hinged on said frame, said cap adapted to capture and retain said membrane in a position that encloses the chamber for the photographs.

4. The container of claim 3 including photograph locating projections extending from said frame so as to locate a stack of photographs in the photograph accepting chamber.

5. The container of claim 4 including a catch projection on said central frame adapted to engage a hole in said membrane so as to help hold said membrane in position about said frame.

6. The container of claim 5 in which said membrane comprises non-acid paperboard.

7. The container of claim 1 in which said stacking projections comprise side walls to said frame.

8. The container of claim 7 in which said side walls have indentations at the lower edge of size and shape to accept the upper edge of said side walls so as to allow other containers of identical design to said container to be stacked one upon another.

9. The container of claim 7 including ledges extending from said lower edge of said side wall under said membrane so as to hold the membrane against some of said projecting means.

10. The container of claim 6 in which said stacking projections comprise side walls to said frame.

11. The container of claim 10 in which said side walls have indentations at the lower edge of size and shape to accept the upper edge of said side walls so as to allow other containers of identical design to said container to be stacked one upon another.

12. The container of claim 11 including ledges extending from said lower edge of said side wall under said membrane so as to hold the membrane against some of said projecting means.

13. The container of claim 1 in which said frame comprises polypropylene.

14. The container of claim 6 in which said central frame comprises polypropylene.

15. The container of claim 12 in which said central plastic frame is molded from polypropylene.

16. The container of claim 10 including locking pin projections extending from said side walls and adapted to enter holes in said cap so as to hold said cap closed.

17. A container for storing photograph prints and/or negatives comprising:

a central molded plastic frame having an open end wall;

a flexible membrane shaped and adapted to wrap about said frame and form a top wall for the container;

projecting means on said frame adapted to space said membrane from said frame so as to create a chamber between said frame and the top wall of said membrane, said chamber being sized to accept a stack of horizontally disposed, adjacent photograph prints; and a plastic cap integrally hinged on said frame, said cap adapted to capture and retain said membrane in a position that encloses the end wall of said frame and an end wall of the chamber for the stack of photograph prints.

18. The container of claim 17 including a cap hinged on said frame, said cap adapted to capture and retain said membrane in a position that encloses the chamber for the photograph prints.

19. A container for storing photograph prints and/or negatives comprising:

a central molded plastic frame;

a flexible membrane shaped and adapted to wrap about said frame;

projecting means on said frame adapted to space said membrane from said frame so as to create at least one chamber between said frame and said membrane, said at least one chamber being sized to accept photograph prints and/or negatives therewithin; and a catch projection on said central frame adapted to engage a hole in said membrane so as to help hold said membrane in position about said frame.

20. A container for storing photograph prints and/or negatives comprising:

a central molded plastic frame;

a flexible, non-acid, resin coated membrane shaped and adapted to wrap about said frame; and projecting means on said frames adapted to space said frame so as to create at least one chamber between said frame and said membrane, said at least one chamber being sized to accept photograph prints and/or negatives therewithin.

21. The container of claim 20 in which said coating contains an ultraviolet absorber.

* * * * *